US009397421B2

(12) United States Patent
Ozeki

(10) Patent No.: US 9,397,421 B2
(45) Date of Patent: Jul. 19, 2016

(54) ELECTRICAL CONNECTOR

(71) Applicant: Daiichi-Seiko Co., Ltd., Kyoto-shi, Kyoto (JP)

(72) Inventor: Kosuke Ozeki, Ogori (JP)

(73) Assignee: DAIICHI-SEIKO CO., LTD., Kyoto-Shi, Kyoto (KR)

( * ) Notice: Subject to any disclaimer, the term of this patent is extended or adjusted under 35 U.S.C. 154(b) by 0 days.

(21) Appl. No.: 14/850,748

(22) Filed: Sep. 10, 2015

(65) Prior Publication Data

US 2016/0099511 A1 Apr. 7, 2016

(30) Foreign Application Priority Data

Oct. 3, 2014 (JP) ..... 2014-204906

(51) Int. Cl.
*H01R 12/79* (2011.01)
*H01R 12/70* (2011.01)
*H01R 12/88* (2011.01)

(52) U.S. Cl.
CPC ..... *H01R 12/7076* (2013.01); *H01R 12/88* (2013.01)

(58) Field of Classification Search
USPC ..... 439/260, 329, 495
See application file for complete search history.

(56) References Cited

U.S. PATENT DOCUMENTS 6,224,418 B1 * 5/2001 Miura ..... H01R 12/79 439/260
7,677,917 B2 * 3/2010 Hemmi ..... H01R 12/88 439/495
7,833,046 B2 * 11/2010 Tamura ..... H01R 12/774 439/329
8,920,183 B2 * 12/2014 Shimada ..... H01R 12/88 439/260
2005/0208824 A1 * 9/2005 Kayama ..... H01R 12/88 439/495
2008/0081501 A1 * 4/2008 Hemmi ..... H01R 12/79 439/329
2010/0029119 A1 * 2/2010 Taketomi ..... H01R 23/661 439/329
2014/0057475 A1 * 2/2014 Tohjo ..... H01R 12/88 439/329

FOREIGN PATENT DOCUMENTS

JP 2009-081073 4/2009

* cited by examiner

*Primary Examiner* — Tho D Ta
(74) *Attorney, Agent, or Firm* — Howard & Howard Attorneys PLLC

(57) ABSTRACT

A housing 11 comprises a lower receiver 11*a* extending from the back to front of a loading slot 15 and comprising a flat plate-like mounting surface Sa extending in the array direction of lower beams and on which the lower beams are mounted. Furthermore, the housing 11 comprises ribs 11*b* provided on the mounting surface Sa and extending from the back to front of the loading slot 15 to form grooves Za for retaining the lower beams. The ends of the ribs 11*b* that are situated in the front of the loading slot 15 are disposed closer to the back of the loading slot 15 than the end of the lower receiver 11*a* that is situated in the front of the loading slot 15.

6 Claims, 10 Drawing Sheets

ELECTRICAL CONNECTOR

CROSS-REFERENCE TO RELATED APPLICATION

This application claims the benefit of Japanese Patent Application No. 2014-204906, filed on Oct. 3, 2014, the entire disclosure of which is incorporated by reference herein.

FIELD

This application relates generally to an electrical connector having contacts that make contact with and are connected to signal terminals provided on a plate-like signal transfer member such as a flexible printed circuit (FPC) and flexible flat cable (FFC) for electrically coupling the signal terminals on the signal transfer member to other electrical parts, being of the type into which a signal transfer member is loaded, and mounted on a wiring board or the like.

BACKGROUND

In order to electrically connect a relatively small signal transfer member such as an FPC and FFC mounted on various kinds of electronic devices to an wiring board on which various electrical parts are mounted, an electrical connector electrically connected and fixed to (mounted on) the wiring board is often used.

With the electrical connector mounted on such a wiring board, when the connection part of a contact made of a conductive material and constituting the electrical connector (the part to be, for example, soldered to an electrode on the wiring board on which the electrical connector is mounted) and the housing wall surface made of an insulating material and facing the connection part are closely spaced, solder or flux may run between the connection part and housing wall surface while the wiring board and connection part are reflow-soldered. The same phenomenon occurs when the lower beam extending from the connection part and the housing wall surface facing the lower beam are closely spaced. The solder or flux may run between the lower beam and housing wall surface.

Furthermore, the solder or flux may run between the coupling part coupling the lower beam to the upper beam facing the lower beam and the housing wall surface facing the coupling part, run between the upper beam and the housing wall surface facing the upper beam, and adhere to the signal contact part provided on the upper beam (the part that can make contact with a signal terminal on the signal transfer member).

Here, the flux contains natural plant resins, such as pine resin, dissolving before the solder and removing oxides and contaminants on the fused solder surface and metal portion.

As the flux adheres to the signal contact part, the conduction between the signal contact part and the signal terminal on the signal transfer member is impaired. As an electrical connector that can prevent such a problem, for example, the connector described in Patent Literature 1 is known.

In the electrical connector described in the Patent Literature 1, the distance between the connection part and the housing wall surface facing the connection part is larger than the distance between the lower beam and the housing wall surface facing the lower beam (for example, see FIG. 11 of the Patent Literature 1). This structure prevents the solder or flux from running between the connection part and housing wall surface, in other words prevents the capillary action from occurring between the connection part and housing wall surface.

In the electrical connector described in the Patent Literature 1, the solder or flux does not run between the connection part and housing wall surface and thus the solder or flux does not run between the lower beam and housing wall surface, either. Therefore, the electrical connector described in the Patent Literature 1 can prevent the flux from adhering to the signal contact part.

CITATION LIST

Patent Literature

Patent Literature 1: Unexamined Japanese Patent Application Kokai Publication No. 2009-81073.

SUMMARY

In the electrical connector described in the Patent Literature 1 and the like, along with the demand for overall downsizing of electrical parts, efforts have been made to reduce the pitch of contacts having an upper beam and a lower beam (smaller pitches). Accordingly, efforts have been made to reduce the distance between the connection part and the housing wall surface facing the connection part and the distance between a contact and the housing wall surface facing the contact.

With the above reduction, in the electrical connector described in the Patent Literature 1, the distance between the connection part and the housing wall surface and the distance between a contact and the housing wall surface are small enough for the solder or flux to run. In other words, the distance is small enough to cause the capillary action. Therefore, the electrical connector described in the Patent Literature 1 has a problem that it may fail to prevent the flux from adhering to the signal contact part in the event that the above reduction is made.

The present disclosure is made with the view of the above circumstance and an objective of the disclosure is to make it possible to prevent the flux from adhering to the signal contact part even if the pitch of contacts is reduced.

Solution to Problem

In order to achieve the above objective, the electrical connector according to the present disclosure comprises:

an insulating housing comprising a loading slot into which a plate-like signal transfer member can be loaded; and a plurality of conductive contacts each comprising an upper beam extending from the back to front of the loading slot and comprising a signal contact part that can make contact with a signal terminal situated on one side of the signal transfer member loaded in the housing and a lower beam extending from the back to front of the loading slot, facing the upper beam to be able to clamp the signal transfer member in collaboration with the upper beam, and comprising at the end situated in the front of the loading slot a connection part that is entirely exposed and can be connected to a substrate, wherein the housing comprises:

a lower receiver extending from the back to front of the loading slot and comprising a flat plate-like mounting surface extending in the array direction of the lower beams and on which the lower beams are mounted; and ribs provided on the mounting surface and extending from the back to front of the loading slot to form grooves for retaining the lower beams, and the ends of the ribs that are situated in the front of the loading slot are disposed closer to the back of the loading slot than the end of the lower receiver that is situated in the front of the loading slot.

Furthermore, it is possible that:

the lower beam comprises:

a lower long beam mounted on the mounting surface and extending from the back to front of the loading slot; and a bend disposed between the end of the lower long beam that is situated in the front of the loading slot and the connection part and of which the surface facing the mounting surface is bent toward the upper beam for being spaced from the mounting surface, and the ends of the ribs that are situated in the front of the loading slot are disposed closer to the back of the loading slot than the connection point between the lower long beam and bend.

Furthermore, it is possible that:

the bend extends beyond the end of the lower receiver that is situated in the front of the loading slot so that the connection part is disposed away from the end of the lower receiver that is situated in the front of the loading slot.

Furthermore, it is possible that:

the contacts are first contacts inserted into the housing from the loading slot by being shifted from the front to back of the loading slot and of which the lower beams are retained in the grooves formed by the ribs, and second contacts each comprising an upper beam extending from the back to front of the loading slot and comprising a signal contact part that can make contact with a signal terminal situated on one side of the signal transfer member loaded in the housing and a lower beam extending from the back to front of the loading slot, facing the upper beam to be able to clamp the signal transfer member in collaboration with the upper beam, and comprising at the end situated in the back of the loading slot a connection part that can be connected to a substrate, and each inserted into the housing from an insertion opening on the opposite side to the loading slot by being shifted from the back to front of the loading slot, and of which the lower beams are retained in the grooves formed by the ribs are further provided, and the ends of the ribs that are situated in the front of the loading slot are disposed closer to the back of the loading slot than the ends of the lower beams of the second contacts.

Furthermore, an actuator movably attached to the housing, comprising abutters configured to be able to abut on the contacts, and making the signal contact part and signal terminal contact by pressing the contacts as the abutters move is provided.

Furthermore, it is possible that:

the contacts have a nearly H-shaped contour comprising a coupler coupling the upper beam and lower beam, the abutters each comprise a cam section where a cam is formed, the cam section is clamped by the upper beam and lower beam situated in the back of the loading slot with respect to the coupler as the boundary, and the actuator pushes up the upper beam in the back of the loading slot with the cam section as the cam section rotates, whereby the upper beam in the front of the loading slot with respect to the coupler as the boundary swings to make the signal contact part and signal terminal contact.

According to the present disclosure, the ends of the ribs forming the grooves for retaining the lower beams that are situated in the front of the loading slot are disposed closer to the back of the loading slot than the end of the lower receiver having the mounting surface on which the lower beams are mounted that is situated in the front of the loading slot. Therefore, it is possible to prevent the solder or flux from running between the lower beam and rib even if the solder or flux runs along the connection part and runs between the lower beam and the mounting surface of the lower receiver while, for example, the connection part is soldered to an electrode on the substrate. In other words, it is possible to prevent the capillary action from occurring between the lower beam and rib.

Therefore, according to the present disclosure, it is possible to prevent the flux from adhering to the signal contact part of the upper beam and there is no need of spacing the members in the pitch direction of the contacts, whereby prevention of adhering of the flux can be realized even if the pitch of contacts is reduced.

BRIEF DESCRIPTION OF THE DRAWINGS

A more complete understanding of this application can be obtained when the following detailed description is considered in conjunction with the following drawings, in which.

DETAILED DESCRIPTION

An electrical connector 10 according to an embodiment of the present disclosure will be described hereafter. Here, in each figure, a Cartesian coordinate system of which the x-axis direction, y-axis direction, and z-axis direction coincide with the lateral direction, longitudinal direction, and thickness direction of the electrical connector 10, respectively, is set and made reference to as needed. Furthermore, the arrowed direction of each axis is referred to with the + (plus) sign and the opposite direction is referred to with the – (minus) sign.

Figure 1:
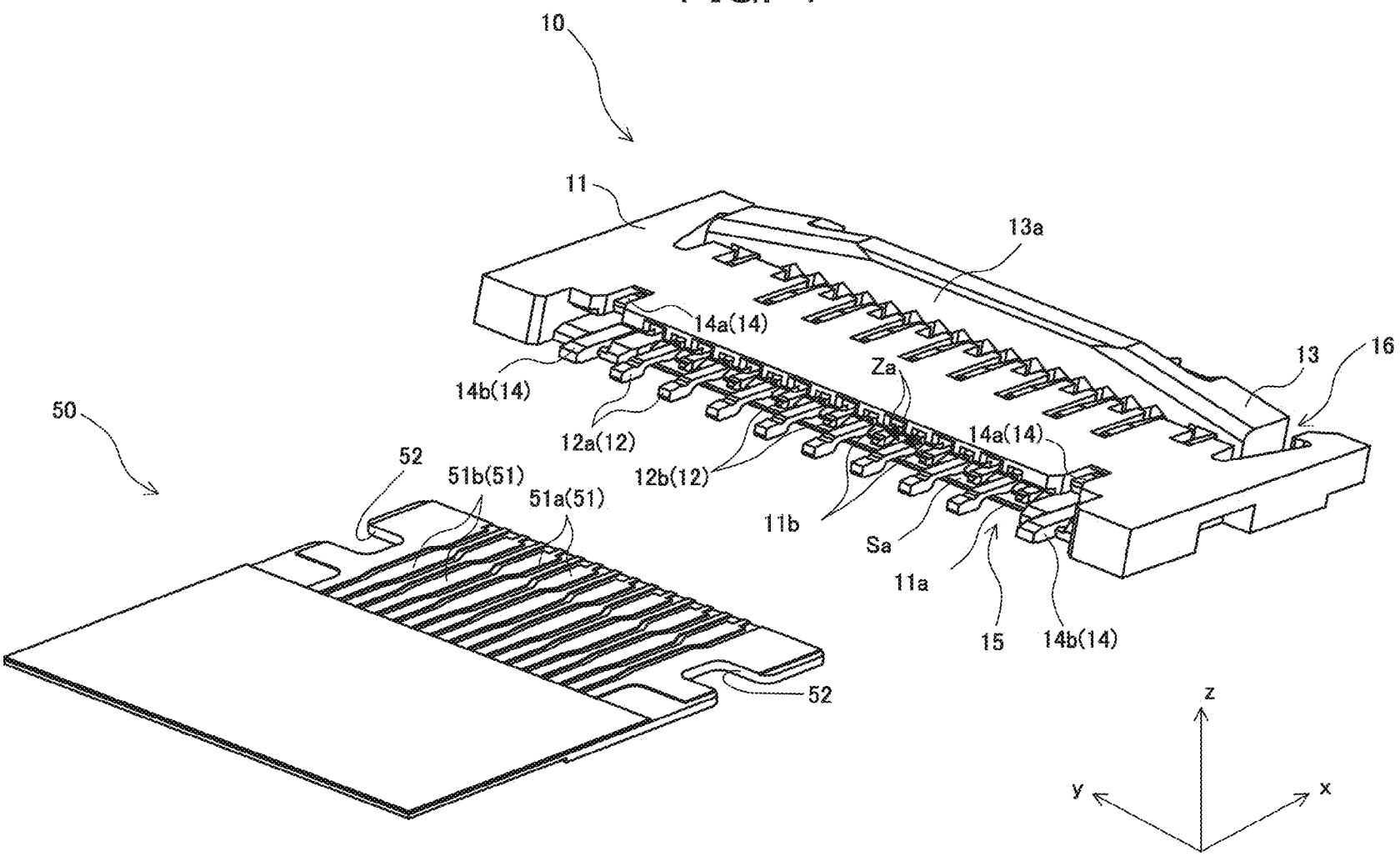
FIG. 1 is a perspective view of the electrical connector according to an embodiment of the present disclosure and a signal transfer member when seen from the loading slot side.
Figure 2:
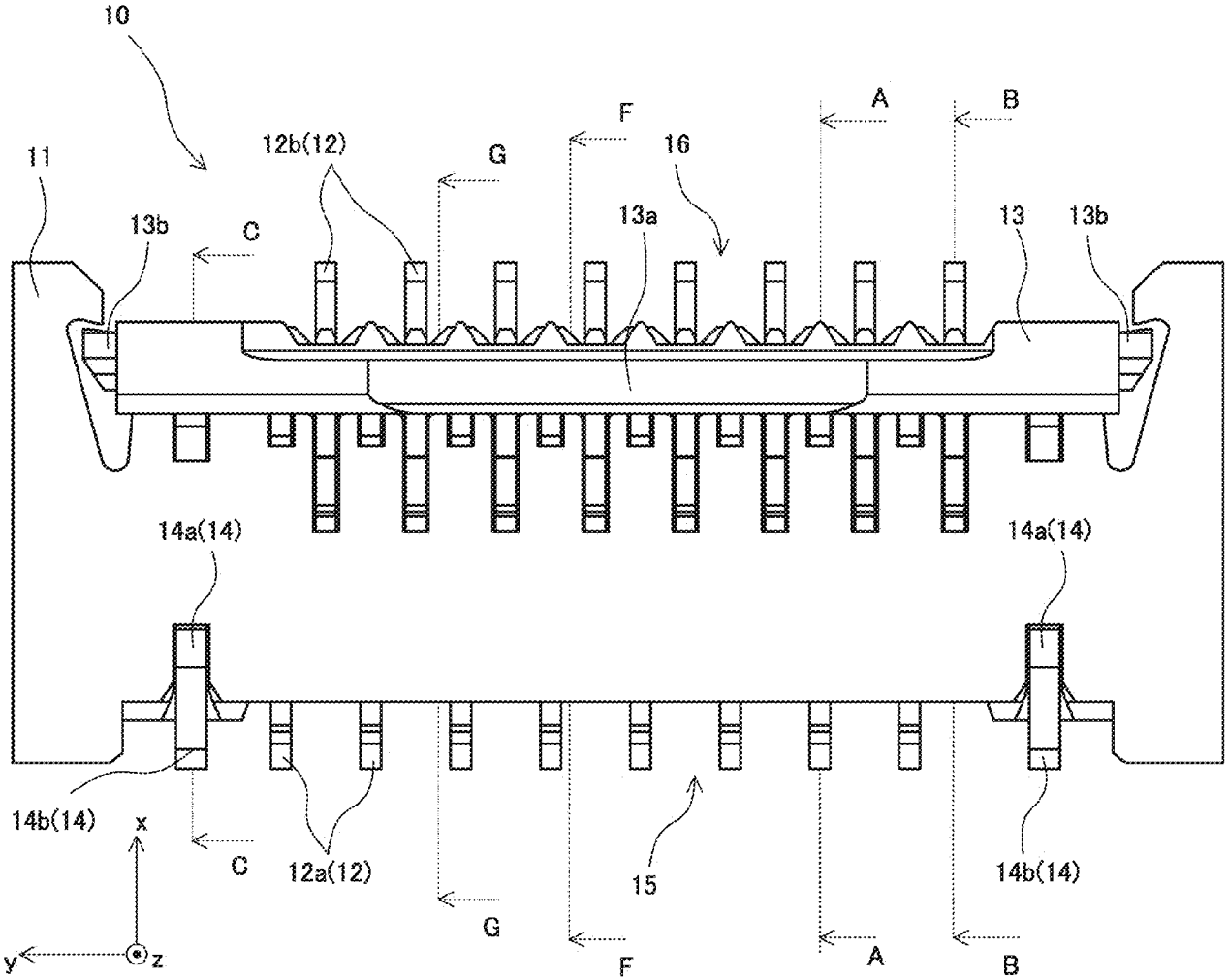
FIG. 2 is a plan view of the electrical connector of the present disclosure.

As shown in FIGS. 1 and 2, the electrical connector 10 comprises a nearly rectangular housing 11, multiple contacts 12 disposed in the housing 11, an actuator 13 rotatably attached to the housing 11, and locks 14 disposed on either longitudinal end of the housing 11.

The housing 11 is made of an insulating material such as a resin and disposed on a wiring board of, for example, an electronic device or the like. The housing 11 has a loading slot 15 into which an FPC 50, which is an exemplary plate-like signal transfer member, can be loaded. The loading slot 15 has a large opening in the front and a small opening in the back.

Furthermore, the housing 11 comprises a lower receiver 11*a* extending from the back to front of the loading slot 15 and having a flat plate-like mounting surface Sa extending in the array direction of the contacts 12 and on which the contacts 12 are mounted.

Furthermore, the housing 11 comprises ribs 11*b* provided on the mounting surface Sa of the lower receiver 11*a* and extending from the back to front of the loading slot 15 so as to form grooves Za in the form of a corresponding recess for retaining the multiple contacts 12.

The FPC 50 that is to be loaded in the loading slot 15 of the housing 11 has electrodes 51 connected to the wiring. The electrodes 51 comprise first electrodes 51*a* provided at one end of the FPC 50 and second electrodes 51*b* provided away from the one end of the FPC 50. Furthermore, the FPC 50 has notches 52 that are to be locked on the locks 14.

The contacts 12 are each a conductor made of a metal plate or the like and elastic. The contacts 12 comprise first contacts 12*a* disposed at positions corresponding to the first electrodes 51*a* of the FPC 50 loaded in the housing 11. Furthermore, the contacts 12 comprise second contacts 12*b* disposed at positions corresponding to the second electrode 51*b* of the FPC 50 loaded in the housing 11.

In assembling the electrical connector 10 (before the actuator 13 is attached to the housing 11), the first contacts 12*a* are inserted into the housing 11 from the loading slot 15 by being shifted from the front to back of the loading slot 15.

On the other hand, in assembling the electrical connector 10 (before the actuator 13 is attached to the housing 11), the second contacts 12*b* are inserted into the housing 11 from an insertion opening 16 that is on the opposite side to the loading slot 15 by being shifted from the back to front of the loading slot 15.

At this point, the first contacts 12*a* and second contacts 12*b* are inserted in the grooves Za and the like of the housing 11 and thereby fixed to the housing 11. The first contacts 12*a* and second contacts 12*b* are disposed alternately in the longitudinal direction of the housing 11 (the y-axis direction).

Figure 3:
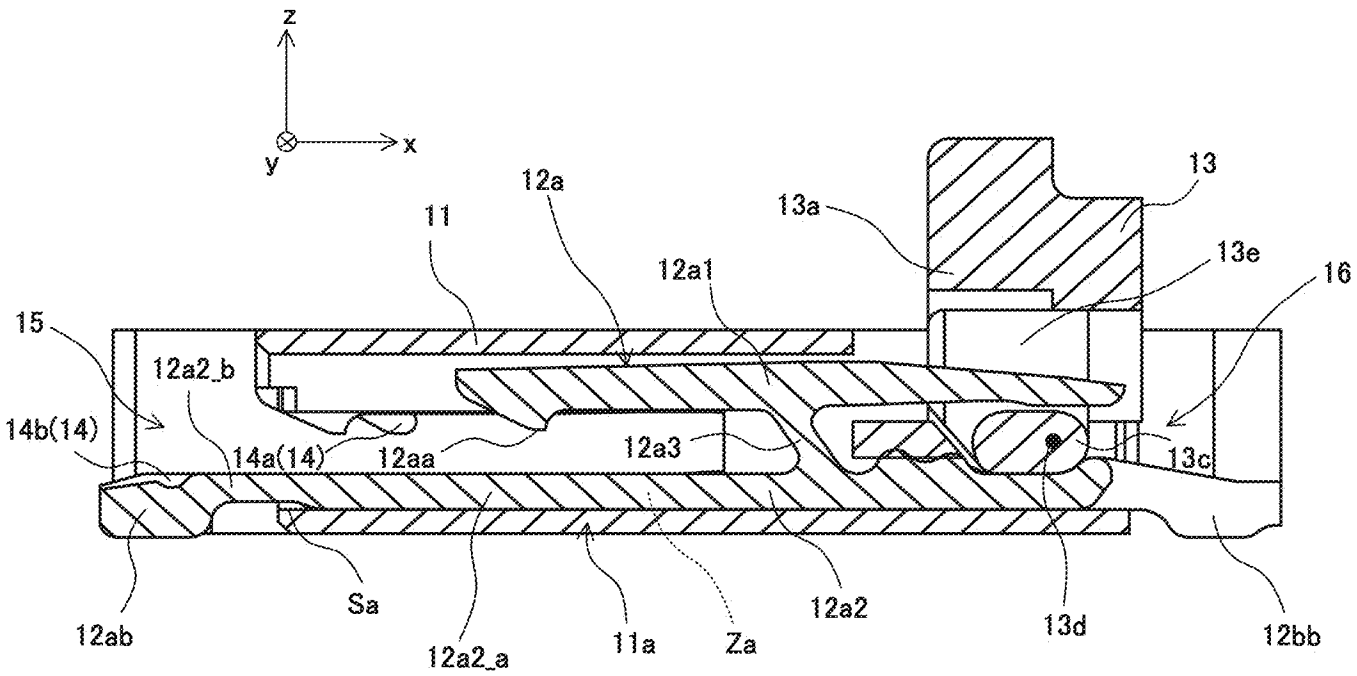
FIG. 3 is a cross-sectional view at the line A-A of the electrical connector shown in FIG. 2.

The first contacts 12*a* each comprise, as shown in FIG. 3 (a cross-sectional view at the line A-A shown in FIG. 2), a pair of beams 12*a*1 and 12*a*2 (an upper beam 12*a*1 and a lower beam 12*a*2 longer than the upper beam 12*a*1).

The upper beam 12*a*1 and lower beam 12*a*2 extend from the back to front of the loading slot 15. The upper beam 12*a*1 comprises a first signal contact part 12*aa* so disposed at the end situated in the front of the loading slot 15 as to be able to make contact with a first electrode 51*a*.

The lower beam 12*a*2 faces the upper beam 12*a*1 so as to be able to clamp the FPC 50 loaded in the housing 11 in collaboration with the upper beam 12*a*1. The lower beam 12*a*2 comprises a first connection part 12*ab* that is soldered to an electrode on the wiring board of, for example, an electronic device or the like at the end situated in the front of the loading slot 15. The first connection part 12*ab* is entirely exposed except for the connection surface.

Furthermore, the lower beam 12*a*2 comprises a lower long beam 12*a*2_*a* mounted on the mounting surface Sa of the lower receiver 11*a* and extending from the back to front of the loading slot 15. The lower long beam 12*a*2_*a* is retained in a groove Za formed by the ribs 11*b*.

Furthermore, the lower beam 12*a*2 comprises a bend 12*a*2_*b* disposed between the end of the lower long beam 12*a*2_*a* that is situated in the front of the loading slot 15 and the first connection part 12*ab* and of which the surface facing the mounting surface Sa is bent toward the upper beam 12*a*1 for being spaced from the mounting surface Sa.

The above-described first contacts 12*a* each comprise a pillar 12*a*3 connecting the upper beam 12*a*1 and lower beam 12*a*2. With the upper beam 12*a*1 and lower beam 12*a*2 being connected by the pillar 12*a*3, the first contacts 12*a* have a nearly H-shaped contour.

The pair of beams (the upper beam 12*a*1 and lower beam 12*a*2) situated on one side of each first contact 12*a* with respect to the pillar 12*a*3 as the boundary is disposed on the inner periphery of the loading slot 15 of the housing 11 and the first signal contact part 12*aa* is protruded in part.

Furthermore, the pair of beams (the upper beam 12*a*1 and lower beam 12*a*2) situated on the other side of each first contact 12*a* with respect to the pillar 12*a*3 as the boundary is disposed on the side of the housing 11 closer to the insertion opening 16. Then, the upper beam 12*a*1 is exposed from the housing 11.

A cam section 13*c*, which is ellipsoidal in cross-section, of the actuator 13 described later is positioned between the pair of beams (the upper beam 12*a*1 and lower beam 12*a*2) situated on the other side of each first contact 12*a*.

As the pair of beams situated on the other side of each first contact 12*a* retains a cam section 13*c* of the actuator 13, the actuator 13 can rotate with respect to the housing 11. Thus, the cam section 13*c* can rotate about the axis 13*d* in accord with the rotation of the actuator 13. Furthermore, the upper beam 12*a*1 situated on the other side of each first contact 12*a* is inserted in a slit 13*e* formed directly above the cam section 13*c*.

Figure 4:
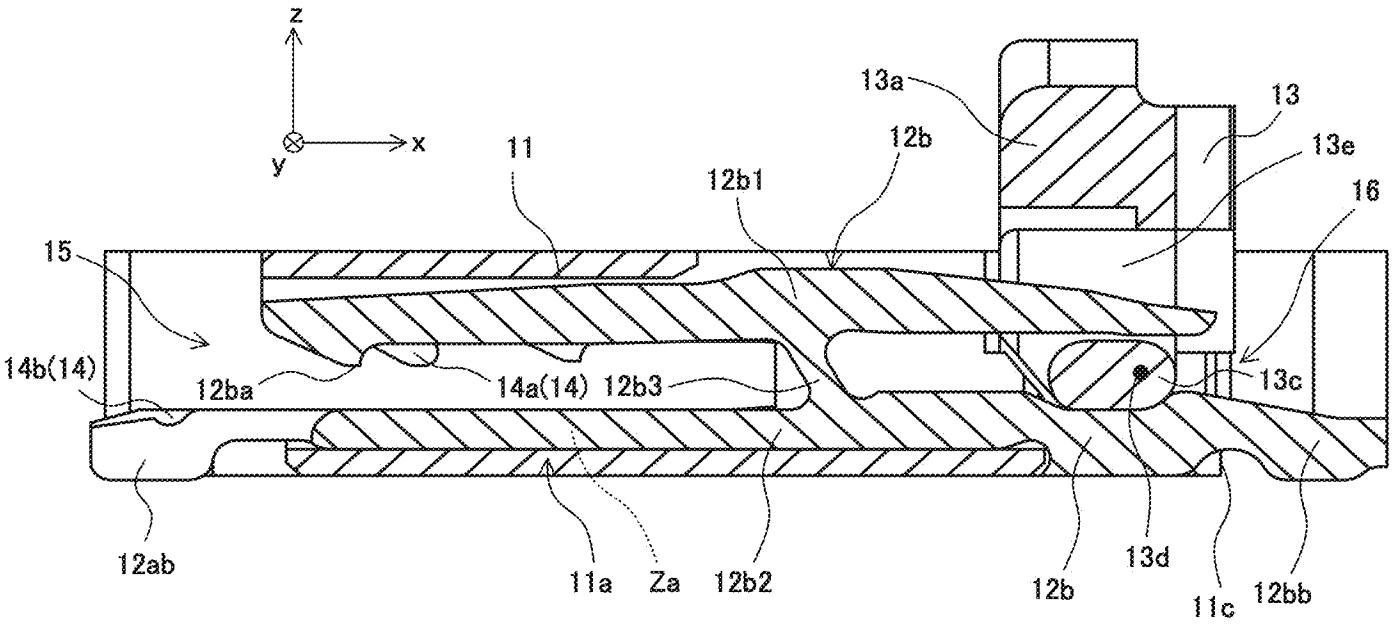
FIG. 4 is a cross-sectional view at the line B-B of the electrical connector shown in FIG. 2.

Subsequently, as shown in FIG. 4, the second contacts 12*b* each comprise a pair of beams 12*b*1 and 12*b*2 (an upper beam 12*b*1 and a lower beam 12*b*2 longer than the upper beam 12*b*1).

The upper beam 12*b*1 and lower beam 12*b*2 extend from the back to front of the loading slot 15. The upper beam 12*b*1 comprises a second signal contact part 12*ba* so disposed at the end situated in the front of the loading slot 15 as to be able to make contact with a second electrode 51*b*.

The lower beam 12*b*2 faces the upper beam 12*b*1 so as to be able to clamp the FPC 50 loaded in the housing 11 in collaboration with the upper beam 12*b*1. The lower beam 12*b*2 is retained in a groove Za formed by the ribs 11*b*.

Furthermore, the lower beam 12*b*2 comprises a second connection part 12*bb* that is soldered to an electrode on the wiring board of, for example, an electronic device or the like at the end closer to the insertion opening 16 of the housing 11 (at the end situated in the back of the loading slot 15).

The above-described second contacts 12*b* each comprise a pillar 12*b*3 connecting the upper beam 12*b*1 and lower beam 12*b*2. With the upper beam 12*b*1 and lower beam 12*b*2 being connected by the pillar 12*b*3, the second contacts 12*b* have a nearly H-shaped contour.

The pair of beams (the upper beam 12*b*1 and lower beam 12*b*2) situated on one side of each second contact 12*b* with respect to the pillar 12*b*3 as the boundary is disposed on the inner periphery of the loading slot 15 of the housing 11 and the second signal contact part 12*ba* is protruded in part.

Furthermore, the pair of beams (the upper beam 12*b*1 and lower beam 12*b*2) situated on the other side of each second contact 12*b* with respect to the pillar 12*a*3 as the boundary is disposed on the side of the housing 11 closer to the insertion opening 16. Additionally, the upper beam 12*b*1 is exposed from the housing 11. Like the first contacts 12*a*, a cam section 13*c* of the actuator 13 is disposed between this pair of beams (the upper beam 12*b*1 and lower beam 12*b*2). As a result, the cam section 13*c* of the actuator 13 is retained by the pair of beams situated on the other side of the second contact 12*b*.

The actuator 13 is, for example, as shown in FIGS. 1 and 2, disposed on the side of the housing 11 closer to the insertion opening 16 (the side opposite to the loading slot 15). The actuator 13 comprises an operator 13*a* extending along the longitudinal direction of the housing 11 (the y-axis direction). Furthermore, the actuator 13 comprises, as shown in FIG. 2, abutters 13*b* disposed on either longitudinal end of the operator 13*a*. The operator 13*a* is disposed with its longitudinal direction nearly coinciding with the longitudinal direction of the housing 11.

The abutters 13*b* are housed in recesses formed in the lateral ends of the housing 11. As a result, the actuator 13 is attached to the housing 11 and the recesses function as a retainer for the housing 11 in the case of the actuator 13 receiving an unexpected force.

Furthermore, as shown in FIGS. 3 and 4, the actuator 13 is integrally provided with the multiple cam sections 13*c* integrally extending from the abutters 13*b* via the slit 13*e*, operating the first contacts 12*a* and second contacts 12*b*, and having a cross-section comprising orthogonal short and long sides. As described above, the cam sections 13*c* are retained by the pairs of beams (the upper beam 12*a*1 and lower beam 12*a*2) situated on the other side of the first contacts 12*a* and the pairs of beams (the upper beam 12*b*1 and lower beam 12*b*2) situated on the other side of the second contacts 12*b*.

Figure 5:
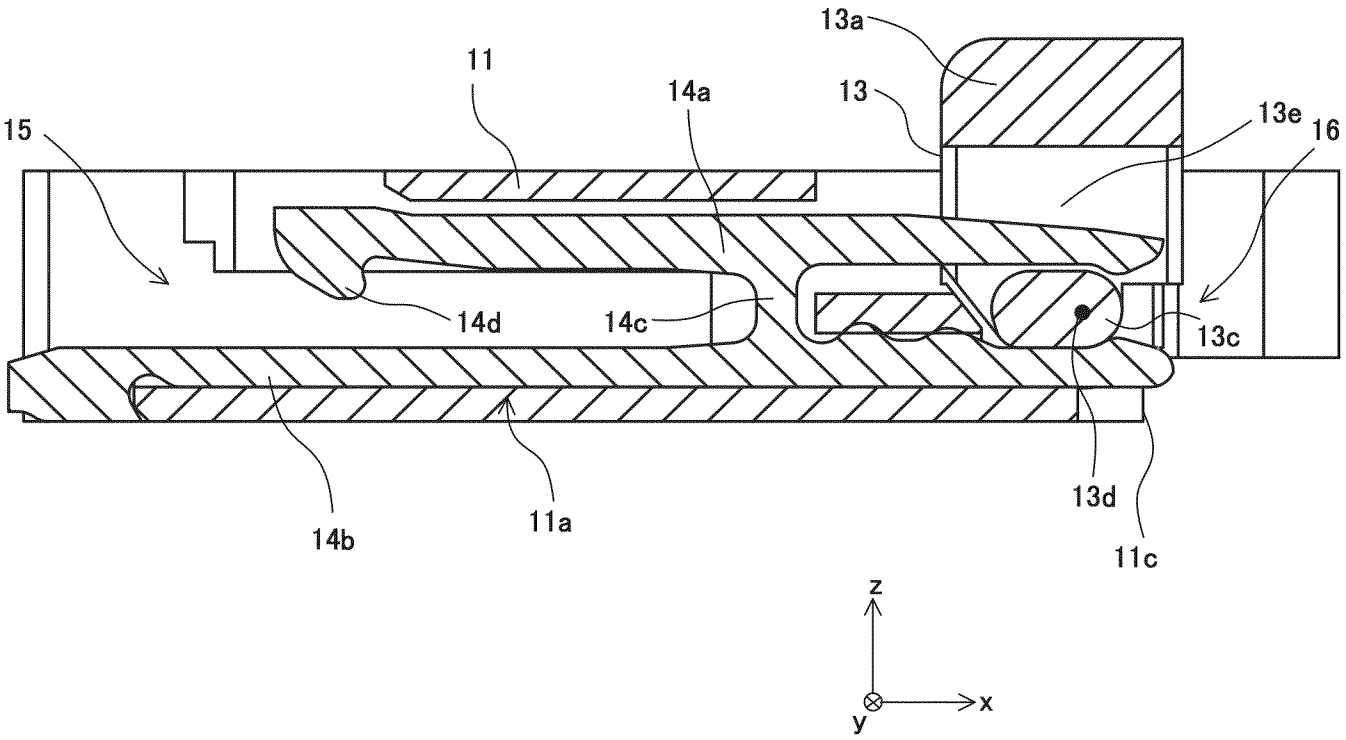
FIG. 5 is a cross-sectional view at the line C-C of the electrical connector shown in FIG. 2.

Furthermore, the cam sections 13*c* are configured to be able to make contact with the locks 14 as well. The locks 14 each comprise, like the first contacts 12*a* and second contacts 12*b*, a pair of beams 14*a* and 14*b* (an upper beam 14*a* and a lower beam 14*b* longer than the upper beam 14*a*) as shown in FIG. 5 (a cross-sectional view at the line C-C shown in FIG. 2).

Furthermore, the locks 14 each comprise a pillar 14*c* connecting the upper beam 14*a* and lower beam 14*b*. With the upper beam 14*a* and lower beam 14*b* being connected by the pillar 14*c*, the locks 14 have a nearly H-shaped contour like the first contacts 12*a* and second contacts 12*b*.

The pair of beams situated on one side of each lock 14 with respect to the pillar 14*c* as the boundary is disposed on the inner periphery of the loading slot 15 of the housing 11. Of the pair of beams situated on the one side of each lock 14, the upper beam 14*a* is provided at the end with a claw 14*d* that is a protrusion for locking in a notch 52 of the FPC 50.

Furthermore, a cam section 13*c* of the actuator 13 is disposed between the pair of beams (the upper beam 14*a* and lower beam 14*b*) situated on the other side of each lock 14 with respect to the pillar 14*c* as the boundary (the side closer to the insertion opening 16). As a result, the cam sections 13*c* are retained by the pairs of beams situated on the other side of the locks 14 as well.

The connection operation of the electrical connector 10 comprising the above-described members will be described. It is assumed that at least the first connation parts 12*ab* and second connection parts 12*bb* are already soldered to electrodes on the wiring board in the electrical connector 10. In the electrical connector 10, when the actuator 13 is in the opened state (the actuator 13 is nearly perpendicular to the loading direction of the FPC 50), for example, as shown in FIGS. 3 to 5, the pairs of beams of the first contacts 12*a*, second contacts 12*b*, and locks 14 each clamp a cam section 13*c* at two points forming a short side in a cross-section.

As a result, the distance between each pair of beams of the first contacts 12*a*, second contacts 12*b*, and locks 14 is larger than when the actuator 13 is in the locked state (larger than when the actuator 13 is nearly horizontal to the loading direction of the FPC 50). At this point, the distance between the pair of beams situated on the one side of each first contact 12*a* and the distance between the pair of beams situated on the one side of each second contact 12*b* are larger than when the actuator 13 is in the locked state.

Therefore, the contacts 12 apply no or marginal contact pressure to the FPC 50 and thus the user can load the FPC 50 into the loading slot 15 of the housing 11 to house the FPC 50 in the housing 11 (move in the +x direction).

Figure 6A:
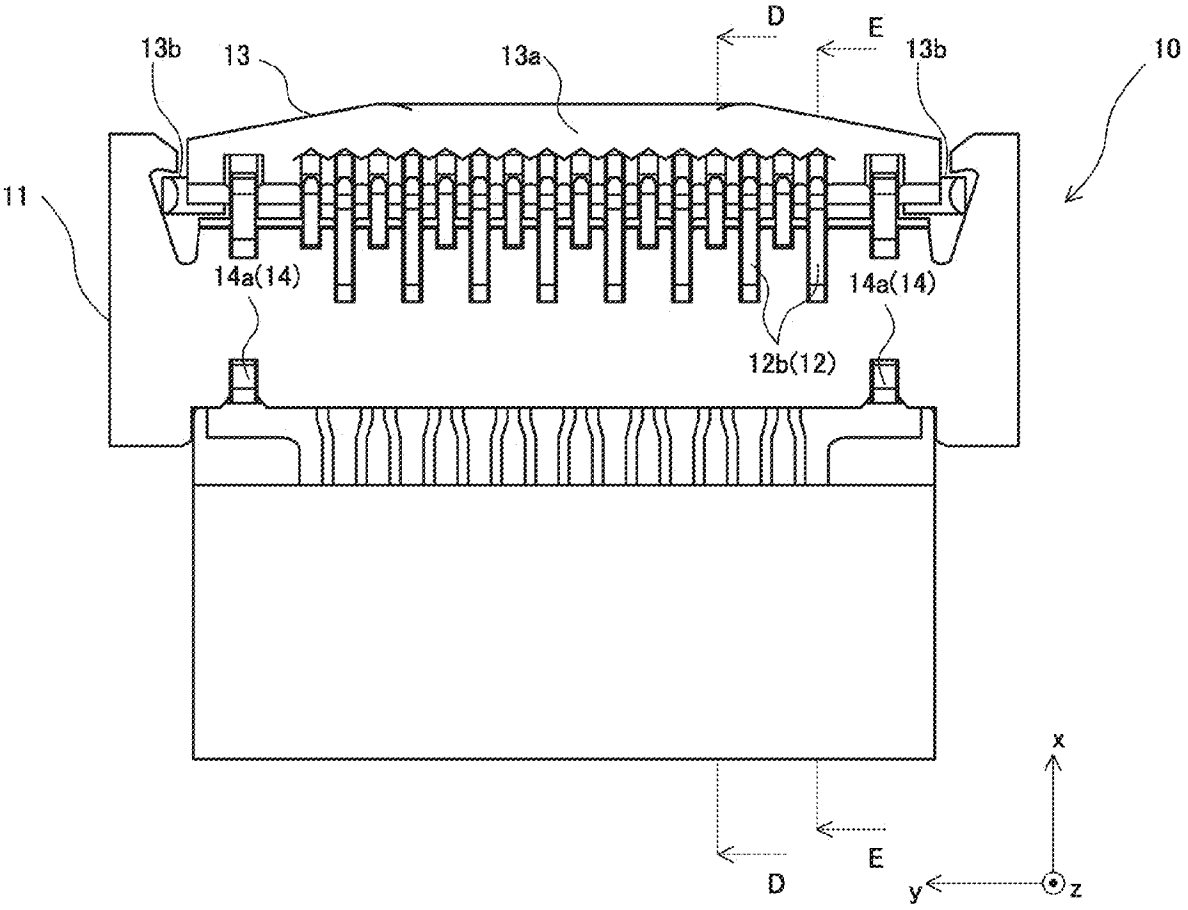
FIG. 6A is a plan view of the electrical connector with the signal transfer member loaded in the loading slot.
Figure 6B:
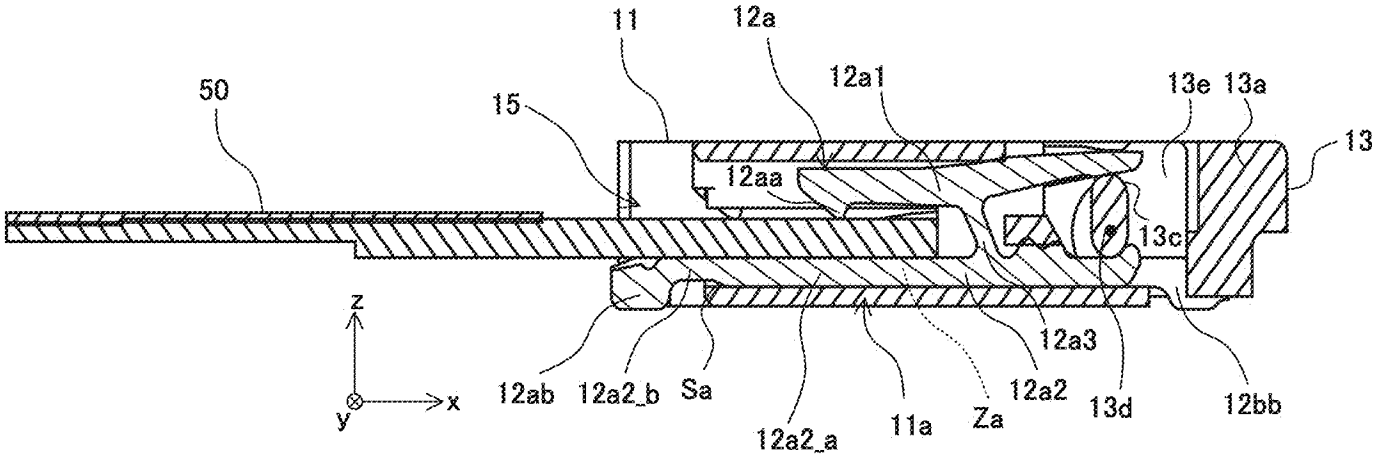
FIG. 6B is a cross-sectional view at the line D-D of the electrical connector shown in FIG. 6A.
Figure 6C:
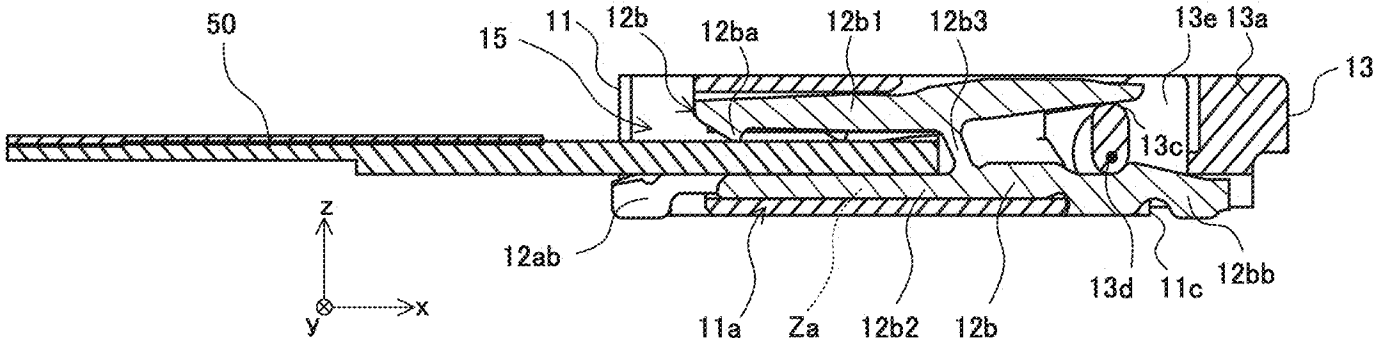
FIG. 6C is a cross-sectional view at the line E-E of the electrical connector shown in FIG. 6A.

As the operator rotates the opened actuator 13, the actuator 13 becomes nearly horizontal to the loading direction of the FPC 50, namely is locked, as shown in FIGS. 6A to 6C. While the actuator 13 is rotated from the opened state to the locked state, the cam sections 13*c* of the actuator 13 rotate about the axis 13*d*.

When the actuator 13 is in the locked state, as shown in FIG. 6B (a cross-sectional view at the line D-D shown in FIG. 6A), the pair of beams (the upper beam 12*a*1 and lower beam 12*a*2) situated on the other side of each first contact 12*a* clamps the cam section 13*c* at two points forming a long side in a cross-section. As a result, the upper beam 12*a*1 situated on the other side of each first contact 12*a* is pushed up.

Similarly, when the actuator 13 is in the locked state, as shown in FIG. 6C (a cross-sectional view at the line E-E shown in FIG. 6A), the pair of beams (the upper beam 12*b*1 and lower beam 12*b*2) situated on the other side of each second contact 12*b* clamps the cam section 13*c* at two points forming a long side in a cross-section. As a result, the upper beam 12*b*1 situated on the other side of each second contact 12*b* is pushed up.

Then, the upper beam 12*a*1 situated on the one side of each first contact 12*a* and the upper beam 12*b*1 situated on the one side of each second contact 12*b* swing. At this point, the distance between the pair of beams situated on the one side of each first contact 12*a* and the distance between the pair of beams situated on the one side of each second contact 12*b* are smaller than when the actuator 13 is in the opened state. Therefore, the first signal contact part 12*aa* and first electrode 51*a* make contact and so do the second signal contact part 12*ba* and second electrode 51*b* (the contacts 12 apply contact pressure to the FPC 50).

Furthermore, when the actuator 13 is in the locked state, the pair of beams (the upper beam 14*a* and lower beam 14*b*) situated on the other side of each lock 14 also clamps the cam section 13*c* at two points forming a long side in a cross-section.

Then, the upper beam 14*a* situated on the one side of each lock 14 swings. At this point, the distance between the pair of beams (the upper beam 14*a* and lower beam 14*b*) situated on the one side of each lock 14 is smaller than when the actuator 13 is in the opened state. Thus, the claw 14*d* provided on the upper beam 14*a* situated on the one side of each lock 14 is locked in the notch 52. Therefore, the FPC 50 is housed in place within the housing 11 and restricted in motion in the −x direction that is the removal direction of the FPC 50, whereby the FPC 50 is completely housed in the housing 11 and the first electrodes 51*a* and second electrodes 51*b* of the FPC 50 and the electrodes on the wiring board corresponding to those electrodes are connected.

Figure 7:
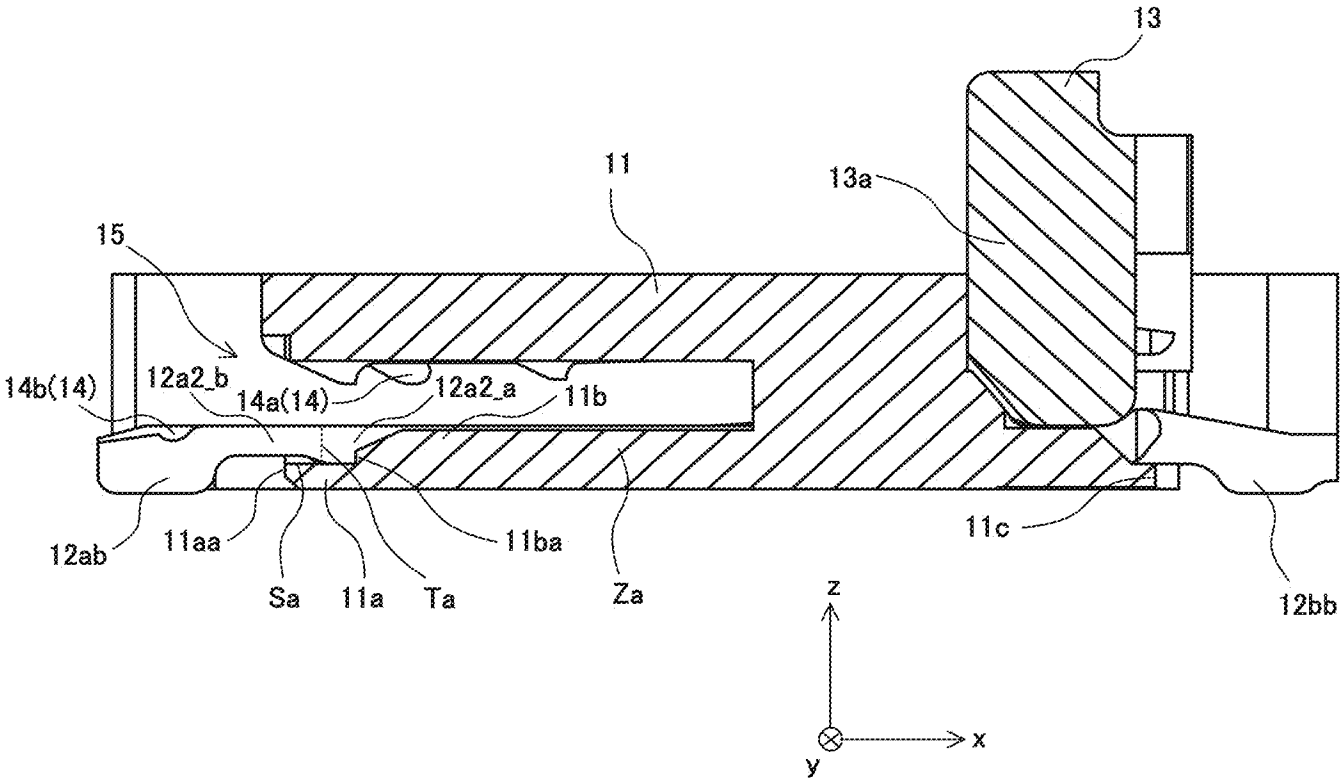
FIG. 7 is a cross-sectional view at the line F-F of the electrical connector shown in FIG. 2.

The efficacy of the present disclosure in the above-described electrical connector 10 will be described. As shown in FIG. 7 (a cross-sectional view at the line F-F shown in FIG. 2) and FIG. 8 (a cross-sectional view at the line G-G shown in FIG. 2), the bend 12*a*2_*b* extends beyond the end 11*aa* of the lower receiver 11*a* so that the first connection part 12*ab* is situated away from the end 11*aa* of the lower receiver 11*a* that is situated in the front of the loading slot 15.

Then, the first connection part 12*ab* can be disposed as much away from the end 11*aa* of the lower receiver 11*a* as possible. Furthermore, the first connection part 12*ab* can entirely be exposed.

As a result, when the first connection part 12*ab* is soldered, for example, to an electrode on the wiring board, it is possible to prevent the solder or flux from reaching between the lower long beam 12*a*2_*a* and the mounting surface Sa of the lower receiver 11*a*. Thus, it is possible to prevent the solder or flux from running between the lower long beam 12*a*2_*a* and the inner wall surfaces of the ribs 11*b*. Therefore, it is possible to prevent the flux from adhering to the first signal contact part 12*aa* of the upper beam 12*a*1.

Here, like the first connection part 12*ab*, the second connection part 12*bb* is also disposed away from the end 11*c* of the housing 11 where the insertion opening 16 is situated. Furthermore, the second connection part 12*bb* is also entirely exposed. Then, when the second connection part 12*bb* is soldered, for example, to an electrode on the wiring board, it is possible to prevent the solder or flux from running between the lower beam 12*b*2 and the inner wall surfaces of the ribs 11*b*. Therefore, it is possible to prevent the flux from adhering to the second signal contact part 12*ba* of the upper beam 12*b*1.

Furthermore, in the electrical connector 10, the end 11*ba* of each rib 11*b* that is situated in the front of the loading slot 15 is, as shown in FIG. 7, closer to the back of the loading slot 15 than the connection point Ta between the lower long beam 12*a*2_*a* and bend 12*a*2_*b*.

Here, in the portion preceding the connection point Ta (the portion closer to the front of the loading slot 15), the surface of the bend 12*a*2-*b* facing the mounting surface Sa is bent toward the upper beam 12*a*1. Therefore, the distance between the bend 12*a*2_*b* and mounting surface Sa is larger than the distance between the lower long beam 12*a*2_*a* and mounting surface Sa. Furthermore, the entire surface of the bend 12*a*2_*b* is exposed.

As a result, when the first connection part 12*ab* is soldered, for example, to an electrode on the wiring board, it is possible to prevent the solder or flux having adhered to the first connection part 12*ab* from reaching between the lower long beam 12*a*2_*a* and the mounting surface Sa of the lower receiver 11*a*. Then, it is possible to prevent the solder or flux from running between the lower long beam 12*a*2_*a* and the mounting surface Sa. Therefore, it is possible to prevent the flux from adhering to the first signal contact part 12*aa* of the upper beam 12*a*1.

Furthermore, in the electrical connector 10, the ribs 11*b* forming the grooves Za for retaining the lower beams 12*a*2 and 12*b*2 are provided on the mounting surface Sa of the lower receiver 11*a* on which the lower beams 12*a*2 and 12*b*2 are mounted, and formed integrally with the housing 11.

Here, the end 11*ba* of each rib 11*b* that is situated in the front of the loading slot 15 is disposed closer to the back of the loading slot 15 than the end 11*aa* of the lower receiver 11*a* that is situated in the front of the loading slot 15. Therefore, the portion of the lower long beam 12*a*2_*a* that is exposed from the end 11*ba* is faced only with the mounting surface Sa.

Then, when the first connection part 12*ab* is soldered, for example, to an electrode on the wiring board, it is possible to suppress the solder or flux running between the lower long beam 12*a*2_*a* and mounting surface Sa and running between the lower long beam 12*a*2_*a* and the inner wall surfaces of the ribs 11*b*. In other words, it is possible to prevent the capillary action from occurring between the lower long beam 12*a*2_*a* and the inner wall surfaces of the ribs 11*b*. Therefore, it is possible to prevent the solder or flux from adhering to the first signal contact part 12*aa* of the upper beam 12*a*1.

Figure 8:
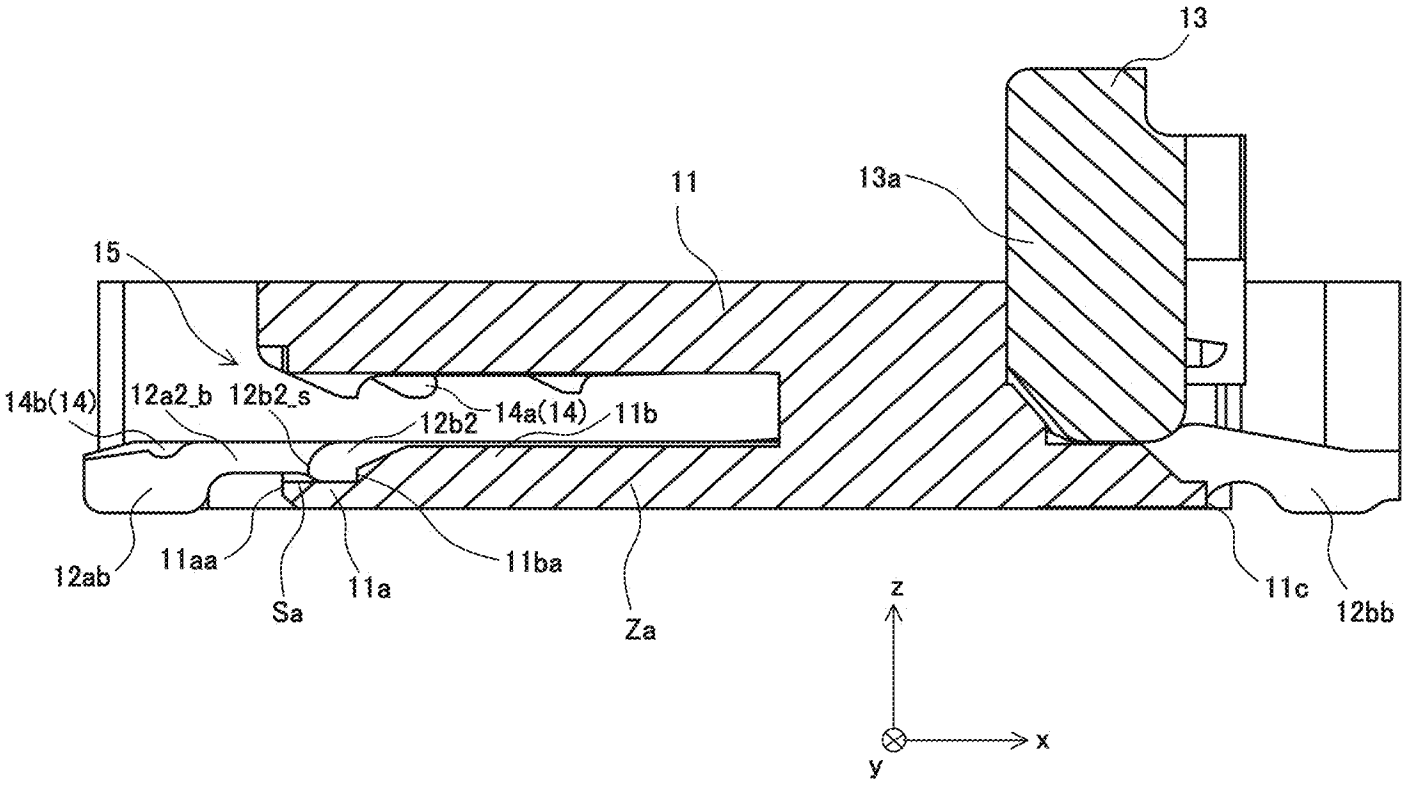
FIG. 8 is a cross-sectional view at the line G-G of the electrical connector shown in FIG. 2.

Furthermore, the end 11*ba* of each rib 11*b* that is situated in the front of the loading slot 15 is, as shown in FIG. 8, closer to the back of the loading slot 15 than the end 12*b*2_*s* of the lower beam 12*b*2 of each second contact 12*b*.

Here, the ribs 11*b* are required only to be capable of retaining the ends of the lower beams 12*a*2 and 12*b*2 in place in the direction along which the contacts 12*a* and 12*b* arrayed. Therefore, the end 12*b*2_*s* of each lower beam 12*b*2 may be exposed from the end 11*ba* of each rib 11*b*.

As just mentioned, the end 11*ba* of each rib 11*b* can be disposed closer to the back of the loading slot 15 to the extent that the end 12*b*2_*s* of each lower beam 12*b*2 is exposed. As a result, when the first connection part 12*ab* is soldered, for example, to an electrode on the wiring board, the effect of preventing the solder or flux from running between the lower beam 12*b*2 and the inner wall surfaces of the ribs 11*b* becomes further prominent.

As described above, in the electrical connector 10 of this embodiment, the end 11*ba* of each rib 11*b* that is situated in the front of the loading slot 15 is disposed closer to the back of the loading slot 15 than the end 11*aa* of the lower receiver 11*a* that is situated in the front of the loading slot 15.

Therefore, when the first connection part 12*ab* is soldered, for example, to an electrode on the wiring board, it is possible to prevent the solder or flux from running between the lower long beam 12*a*2_*a* and the inner wall surfaces of the ribs 11*b* even if the solder or flux runs between lower long beam 12*a*2_*a* and the mounting surface Sa of the lower receiver 11*a* for some reason.

Therefore, the electrical connector 10 of this embodiment can prevent the flux from adhering to the first signal contact part 12*aa* of the upper beam 12*a*1.

Furthermore, according to the electrical connector 10 of this embodiment, like the first connection part 12*ab*, the second connection part 12*bb* is also disposed away from the end 11*c* of the housing 11 where the insertion opening 16 is situated. Furthermore, the second connection part 12*bb* is also entirely exposed. Then, when the second connection part 12*bb* is soldered, for example, to an electrode on the wiring board, it is possible to prevent the solder or flux from running between the lower beam 12*b*2 and the inner wall surfaces of the ribs 11*b*. Therefore, it is possible to prevent the flux from adhering to the second signal contact part 12*ba* of the upper beam 12*b*1.

Furthermore, according to the electrical connector 10 of this embodiment, there is no need of spacing the members in the array direction of the contacts 12*a* and 12*b*. Therefore, the above-described prevention of adhering of the flux can be realized even if the pitch of the contacts 12*a* and 12*b* is reduced.

Furthermore, with the electrical connector 10 of this embodiment, it is possible to prevent the solder or flux from running between the lower long beam 12*a*2_*a* and the inner wall surfaces of the ribs 11*b* and between the lower beam 12*b*2 and the inner wall surfaces of the ribs 11*b*, whereby there is no need of forming through-holes at the lower receiver 11*a* to discharge the solder or flux. Then, there is no need of providing areas where any wiring is prohibited on the wiring board on which the electrical connector 10 is mounted. Therefore, the electrical connector 10 of this embodiment allows for effective use of the wiring board.

An embodiment of the present disclosure is described above. The present disclosure is not confined to the above-described embodiment and various modifications and applications are available.

For example, in the electrical connector 10 of the above-described embodiment, the actuator 13 is of the type rotating with respect to the housing 11. This is not restrictive. The actuator may be of the type sliding with respect to the housing 11.

In such a case, the actuator is attached to the housing 11 slidably from a point closer to the loading slot 15 to a point closer to the insertion opening 16 and from the point closer to the insertion opening 16 to the point closer to the loading slot 15.

When the above actuator is moved to the point closer to the loading slot 15, the actuator abuts on and presses the upper beam 12*a*1 situated on the one side of each first contact 12*a* with respect to the pillar 12*a*3 as the boundary and the upper beam 12*b*1 situated on the one side of each second contact 12*b* with respect to the pillar 12*b*3 as the boundary.

As a result, the upper beam 12*a*1 situated on the one side of each first contact 12*a* and the upper beam 12*b*1 situated on the one side of each second contact 12*b* swing. At this point, the distance between the pair of beams situated on the one side of each first contact 12*a* and the distance between the pair of beams situated on the one side of each second contact 12*b* are smaller than when the actuator is moved to the point closer to the insertion opening 16. Therefore, the first signal contact part 12*aa* and first electrode 51*a* make contact and so do the second signal contact part 12*ba* and second electrode 51*b*.

On the other hand, when the above actuator is moved to the point closer to the insertion opening 16, the actuator no longer abuts on the upper beam 12*a*1 situated on the one side of each first contact 12*a* with respect to the pillar 12*a*3 as the boundary and the upper beam 12*b*1 situated on the one side of each second contact 12*b* with respect to the pillar 12*b*3 as the boundary.

As a result, the upper beam 12*a*1 situated on the one side of each first contact 12*a* and the upper beam 12*b*1 situated on the one side of each second contact 12*b* return to the unpressed state. At this point, the distance between the pair of beams situated on the one side of each first contact 12*a* and the distance between the pair of beams situated on the one side of each second contact 12*b* are larger than when the actuator is moved to the point closer to the loading slot 15. Therefore, the first signal contact part 12*aa* and second electrode 51*a* and the second signal contact part 12*ba* and second electrode 51*b* are no longer in contact (or are in light contact).

As just mentioned, the electrical connector 10 may comprise an actuator slidable with respect to the housing 11 in place of the actuator 13 rotatable with respect to the housing 11.

Furthermore, in the electrical connector 10 of the above-described embodiment, the end 12*b*2_*s* of the lower beam 12*b*2 of each second contact 12*b* is exposed from the end 11*ba* of each rib 11*b*. This is not restrictive. For example, the end 12*b*2_*s* of each lower beam 12*b*2 may be aligned with the end 11*ba* of each rib 11*b* or may be disposed closer to the back of the loading slot 15 than the end 11*ba* of each rib 11*b*.

Furthermore, the electrical connector 10 of the above-described embodiment comprises the locks 14. This is not restrictive. In other words, the electrical connector 10 of the above-described embodiment may not comprise the locks 14.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

REFERENCE SYMBOLS

10 Electrical connector, 11 Housing, 11*a* Lower receiver, 11*aa*, 11*ba*, 11*c*, 12*b*2_*s* End, 11*b* Rib, 12 Contact, 12*a* First contact, 12*b* Second contact, 12*a*1, 12*b*1, 14*a* Upper beam, 12*a*2, 12*b*2, 14*b* Lower beam, 12*a*2_*a* Lower long beam, 12*a*2_*b* Bend, 12*a*3, 12*b*3, 14*c* Pillar, 12*aa* First signal contact part, 12*ab* First connection part, 12*ba* Second signal contact part, 12*bb* Second connection part, 13 Actuator, 13*a* Operator, 13*b* Abutter, 13*c* Cam section, 13*d* Axis, 13*e* Slit, 14 Lock, 14*d* Claw, 15 Loading slot, 16 Insertion opening, 50 FPC, 51 Electrode, 51*a* First electrode, 51*b* Second electrode, 52 Notch, Sa Mounting surface, Ta Connection point, Za Groove.

What is claimed is:

1. An electronic connector, comprising:

an insulating housing comprising a loading slot into which a plate-like signal transfer member can be loaded; and a plurality of conductive contacts each comprising an upper beam extending from the back to front of the loading slot and comprising a signal contact part that can make contact with a signal terminal situated on one side of the signal transfer member loaded in the housing and a lower beam extending from the back to front of the loading slot, facing the upper beam to be able to clamp the signal transfer member in collaboration with the upper beam, and comprising at the end situated in the front of the loading slot a connection part that is entirely exposed and can be connected to a substrate, wherein the housing comprises:

a lower receiver extending from the back to front of the loading slot and comprising a flat plate-like mounting surface extending in the array direction of the lower beams and on which the lower beams are mounted; and ribs provided on the mounting surface and extending from the back to front of the loading slot to form grooves for retaining the lower beams, and the ends of the ribs that are situated in the front of the loading slot are disposed closer to the back of the loading slot than the end of the lower receiver that is situated in the front of the loading slot.

2. The electrical connector according to claim 1, wherein the lower beam comprises:

a lower long beam mounted on the mounting surface and extending from the back to front of the loading slot; and a bend disposed between the end of the lower long beam that is situated in the front of the loading slot and the connection part and of which the surface facing the mounting surface is bent toward the upper beam for being spaced from the mounting surface, and the ends of the ribs that are situated in the front of the loading slot are disposed closer to the back of the loading slot than the connection point between the lower long beam and bend.

3. The electrical connector according to claim 2, wherein the bend extends beyond the end of the lower receiver that is situated in the front of the loading slot so that the connection part is disposed away from the end of the lower receiver that is situated in the front of the loading slot.

4. The electrical connector according to claim 1, wherein the contacts are first contacts inserted into the housing from the loading slot by being shifted from the front to back of the loading slot and of which the lower beams are retained in the grooves formed by the ribs, and second contacts each comprising an upper beam extending from the back to front of the loading slot and comprising a signal contact part that can make contact with a signal terminal situated on one side of the signal transfer member loaded in the housing and a lower beam extending from the back to front of the loading slot, facing the upper beam to be able to clamp the signal transfer member in collaboration with the upper beam, and comprising at the end situated in the back of the loading slot a connection part that can be connected to a substrate, and each inserted into the housing from an insertion opening on the opposite side to the loading slot by being shifted from the back to front of the loading slot, and of which the lower beams are retained in the grooves formed by the ribs are further provided, and the ends of the ribs that are situated in the front of the loading slot are disposed closer to the back of the loading slot than the ends of the lower beams of the second contacts.

5. The electrical connector according to claim 1, comprising:

an actuator movably attached to the housing, comprising abutters configured to be able to abut on the contacts, and making the signal contact part and signal terminal contact by pressing the contacts as the abutters move.

6. The electrical connector according to claim 5, wherein the contacts have a nearly H-shaped contour comprising a coupler coupling the upper beam and lower beam, the abutters each comprise a cam section where a cam is formed, the cam section is clamped by the upper beam and lower beam situated in the back of the loading slot with respect to the coupler as the boundary, and the actuator pushes up the upper beam in the back of the loading slot with the cam section as the cam section rotates, whereby the upper beam in the front of the loading slot with respect to the coupler as the boundary swings to make the signal contact part and signal terminal contact.

* * * * *